US011708628B2

(12) United States Patent
Yamaguchi et al.

(10) Patent No.: US 11,708,628 B2
(45) Date of Patent: Jul. 25, 2023

(54) ALUMINUM ALLOY PROCESSING METHOD AND ALUMINUM ALLOY WORKPIECE

(71) Applicant: HONDA MOTOR CO., LTD., Tokyo (JP)

(72) Inventors: Ayaka Yamaguchi, Tokyo (JP); Satomi Mano, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/665,604

(22) Filed: Feb. 7, 2022

(65) Prior Publication Data

US 2022/0298607 A1 Sep. 22, 2022

(30) Foreign Application Priority Data

Mar. 16, 2021 (JP) ..... 2021-042245

(51) Int. Cl.

| | |
|---|---|
| ***C22F 1/04*** | (2006.01) |
| ***C22C 21/02*** | (2006.01) |
| ***B21J 5/00*** | (2006.01) |
| ***C22F 1/043*** | (2006.01) |
| ***B22D 21/00*** | (2006.01) |
| ***C22C 21/04*** | (2006.01) |

(52) U.S. Cl.

CPC ..... *C22C 21/02* (2013.01); *B21J 5/00* (2013.01); *B22D 21/007* (2013.01); *C22C 21/04* (2013.01); *C22F 1/043* (2013.01)

(58) Field of Classification Search

CPC ..... C22F 1/043; C22C 21/02

See application file for complete search history.

(56) References Cited

U.S. PATENT DOCUMENTS

| | | | | |
|---|---|---|---|---|
| 2009/0000705 | A1* | 1/2009 | Nakai | C22F 1/05 148/417 |
| 2011/0198003 | A1 | 8/2011 | Takemura | |
| 2013/0032255 | A1 | 2/2013 | Hori et al. | |
| 2013/0255841 | A1 | 10/2013 | Hori et al. | |
| 2014/0367001 | A1 | 12/2014 | Inagaki et al. | |
| 2017/0073802 | A1 | 3/2017 | Hori et al. | |
| 2018/0002788 | A1 | 1/2018 | Epale et al. | |

FOREIGN PATENT DOCUMENTS

| | | | |
|---|---|---|---|
| CN | 102812142 | A | 12/2012 |
| CN | 103361520 | A | 10/2013 |
| CN | 103975085 | A | 8/2014 |
| CN | 107208197 | A | 9/2017 |
| JP | 2004292937 | A | 10/2004 |
| JP | 2018507324 | A | 3/2018 |
| JP | 2018111864 | A | 7/2018 |
| WO | 2009081770 | A1 | 7/2009 |

OTHER PUBLICATIONS

Office Action issued in the CN Patent Application No. 202210113719.0, dated Mar. 21, 2023.

* cited by examiner

*Primary Examiner* — Jessee R Roe

(74) *Attorney, Agent, or Firm* — CKC & Partners Co., LLC

(57) ABSTRACT

Provided is a method for processing an aluminum alloy comprising: 0.5% by mass or more and 1.0% by mass or less of Mg, 0.5% by mass or more and 3.0% by mass or less of Si, 0.2% by mass or more and 0.4% by mass or less of Cu, 0.15% by mass or more and 0.25% by mass or less of Mn, 0.1% by mass or more and 0.2% by mass or less of Ti, 0.05% by mass or more and 0.2% by mass or less of Cr, and 120 ppm by mass or less of Sr, the method comprising casting the aluminum alloy and forging the cast aluminum at a temperature of 500° C. or more and 535° C. or less.

2 Claims, 3 Drawing Sheets

ALUMINUM ALLOY PROCESSING METHOD AND ALUMINUM ALLOY WORKPIECE

This application is based on and claims the benefit of priority from Japanese Patent Application No. 2021-042245, filed on 16 Mar. 2021, the content of which is incorporated herein by reference.

BACKGROUND OF THE INVENTION

Field of the Invention

The present invention relates to a method for processing an aluminum alloy and an aluminum alloy workpiece.

Related Art

As a processing method of a low silicon aluminum alloy, for example, a method in which a low silicon aluminum alloy is subjected to casting, followed by hot forging is known.

As a method for obtaining a part, Patent Document 1 discloses a method including: casting an alloy in a mold; after the casting, demolding the part constituting a preform that is still hot; cooling the preform and then subjecting it to an operation suitable for reheating it to a temperature range of from 470° C. to 550° C.; positioning the part between two shells of a die that defines a cavity of dimensions substantially equal to but less than the dimensions of the cavity of the mold; and strongly pressing the two shells together to exert on the part disposed between said shells a combined effect of pressing and surface kneading. Herein, the low silicon aluminum alloy contains silicon at a content between 0.5% and 3%, magnesium at a content between 0.65% and 1%, copper at a content between 0.20% and 0.40%, manganese at a content between 0.15% and 0.25%, titanium at a content between 0.10% and 0.20%, and strontium at a content between 0 ppm and 120 ppm.

Patent Document 1: Japanese Unexamined Patent Application (Translation of PCT Application), Publication No. 2018-507324

SUMMARY OF THE INVENTION

However, there has been a problem that an area average crystal grain size of an aluminum alloy workpiece increases to about 800 μm, and, as a result, it is not possible for the aluminum alloy workpiece to satisfy both desired yield stress and elongation.

An object of the present invention is to provide a method for processing an aluminum alloy, the method enabling the aluminum alloy to satisfy both yield stress and elongation, and to provide an aluminum alloy workpiece.

An aspect of the present invention relates to a method for processing an aluminum alloy containing: 0.5% by mass or more and 1.0% by mass or less of Mg, 0.5% by mass or more and 3.0% by mass or less of Si, 0.2% by mass or more and 0.4% by mass or less of Cu, 0.15% by mass or more and 0.25% by mass or less of Mn, 0.1% by mass or more and 0.2% by mass or less of Ti, 0.05% by mass or more and 0.2% by mass or less of Cr, and 120 ppm by mass or less of Sr, and the method includes casting the aluminum alloy and forging the cast aluminum at a temperature of 500° C. or more and 535° C. or less.

The aluminum alloy may contain 0.1% by mass or more and 0.2% by mass of Cr.

Another aspect of the present invention relates to an aluminum alloy workpiece containing: 0.5% by mass or more and 1.0% by mass or less of Mg, 0.5% by mass or more and 3.0% by mass or less of Si, 0.2% by mass or more and 0.4% by mass or less of Cu, 0.15% by mass or more and 0.25% by mass or less of Mn, 0.1% by mass or more and 0.2% by mass or less of Ti, 0.05% by mass or more and 0.2% by mass or less of Cr, and 120 ppm by mass or less of Sr, and having an area average crystal grain size of 200 μm or less.

The aluminum alloy workpiece may have an area average crystal grain size of 160 μm or less.

According to the present invention, it is possible to provide a processing method which enables the aluminum alloy to satisfy both yield stress and elongation, and to provide an aluminum alloy workpiece.

DETAILED DESCRIPTION OF THE INVENTION

Processing Method of Aluminum Alloy

Figure 1:
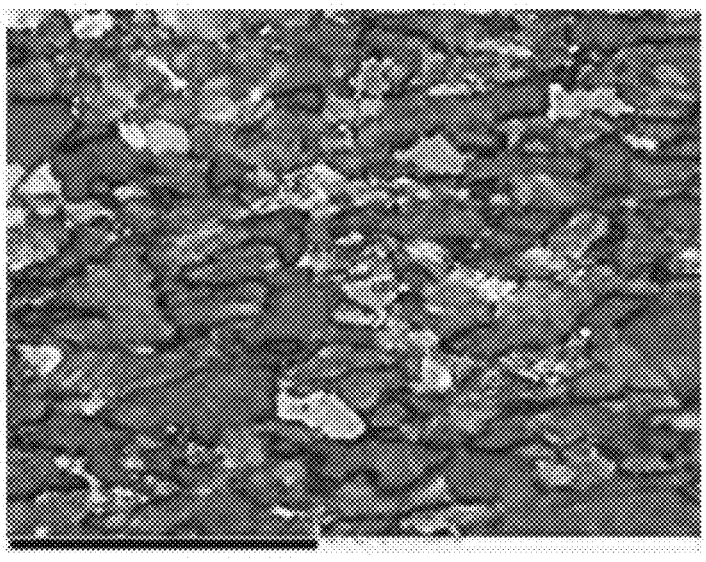
FIG. 1 is a diagram showing a crystal orientation map of the aluminum alloy workpiece of Example 1.

The processing method of an aluminum alloy of the present embodiment is a method of processing an aluminum alloy containing 0.5% by mass or more and 1.0% by mass or less of Mg, 0.5% by mass or more and 3.0% by mass or less of Si, 0.2% by mass or more and 0.4% by mass or less of Cu, 0.15% by mass or more and 0.25% by mass or less of Mn, 0.1% by mass or more and 0.2% by mass or less of Ti, 0.05% by mass or more and 0.2% by mass or less of Cr, and 120 ppm by mass or less of Sr.

The processing method of the aluminum alloy of the present embodiment includes casting an aluminum alloy, and forging the cast aluminum alloy at a temperature of 500° C. or more and 535° C. or less.

In the processing method of an aluminum alloy of the present embodiment, an aluminum alloy containing 0.05% by mass or more and 0.2% by mass or less of Cr is used, whereby a Cr-based precipitate exerts a pinning effect on rearrangement, which prevents recrystallization. This decreases an area average crystal grain size in the aluminum alloy workpiece, which enables the aluminum alloy workpiece to satisfy both yield stress and elongation.

The content of Cr in the aluminum alloy is 0.05% by mass or more and 0.2% by mass or less, and is preferably 0.1% by mass or more and 0.2% by mass or less. When the content of Cr in the aluminum alloy is 0.05% by mass or more, the yield stress of the aluminum alloy workpiece is improved and when the content of Cr in the aluminum alloy is 0.2% by mass or less, the elongation of the aluminum alloy workpiece is improved.

The content of Mg in the aluminum alloy is 0.5% by mass or more and 1.0% by mass or less, and is preferably 0.5% by mass or more and 0.8% by mass or less.

The content of Si in the aluminum alloy is 0.5% by mass or more and 3.0% by mass or less, and is preferably 1.5% by mass or more and 2.5% by mass or less.

The content of Cu in the aluminum alloy is 0.2% by mass or more and 0.4% by mass or less, and is preferably 0.2% by mass or more and 0.3% by mass or less.

The content of Mn in the aluminum alloy is 0.15% by mass or more and 0.25% by mass or less, and is preferably 0.15% by mass or more and 0.2% by mass or less.

The content of Ti in the aluminum alloy is 0.1% by mass or more and 0.2% by mass or less, and is preferably 0.15% by mass or more and 0.2% by mass or less.

The content of Sr in the aluminum alloy is 120 ppm by mass or less, and is preferably 1 ppm by mass or less.

In addition to the above elements, the aluminum alloy may further contain B or the like.

The method of casting the aluminum alloy is not particularly limited, and examples thereof include gravity die casting (GDC), low pressure die casting (LPDC), and the like.

When casting the aluminum alloy, the temperature of a holding furnace which holds molten metal in which the aluminum alloy is molten, is, for example, 700° C. or more and 750° C. or less.

Further, when casting the aluminum alloy, the temperature of the mold is, for example, 150° C. or more and 200° C. or less.

The forging temperature of the aluminum alloy is 500° C. or more and 535° C. or less, and is preferably 525° C. or more and 535° C. or less. When the forging temperature of the aluminum alloy is less than 500° C., the effect achieved by addition of Cr that the area average crystal grain size of the aluminum alloy workpiece is decreased attenuates. When the forging temperature exceeds 535° C., the aluminum alloy locally melts, which generates an inner defect in the aluminum alloy workpiece.

When forging an aluminum alloy, the aluminum alloy is heated by using, for example, an electric furnace or the like.

When forging an aluminum alloy, a mold may be used. At this time, the temperature of the mold is, for example, 150° C. or more and 200° C. or less.

The processing method of the aluminum alloy of the present embodiment may further include a step of melting the forged aluminum alloy, and a step of artificially aging the aluminum alloy subjected to the melting treatment.

Conditions for melting the aluminum alloy are, for example, 4.5 hours or more and hours or less at a temperature of 530° C. or more and 540° C. or less. Further, conditions for the artificial aging treatment of the aluminum alloy are, for example, 4 hours or more and 7 hours or less at a temperature of 155° C. or more and 165° C. or less.

Aluminum Alloy Workpiece

The aluminum alloy workpiece of the present embodiment is an aluminum alloy workpiece described above, having an area average crystal grain size of 200 μm. As a result, the aluminum alloy workpiece of the present embodiment can satisfy both yield stress and elongation.

The area average crystal grain size of the aluminum alloy workpiece of the present embodiment is 200 μm or less, and is preferably 160 μm or less.

The area average crystal grain size of the aluminum alloy workpiece of the present embodiment is usually 30 μm or more.

EXAMPLES

Hereinafter, the Examples of the present invention will be described, but the present invention is not limited to the Examples.

Example 1

(Melting)

An aluminum alloy ingot containing Mg (0.6% by mass), Si (1.8% by mass), Cu (0.2% by mass), Mn (0.15% by mass), Ti (0.17% by mass), Cr (0.1% by mass), Sr (1 ppm by mass or less), and Al (balance) was melted using a melting furnace, to obtain a molten metal. At this time, the quality of the aluminum alloy ingot was measured using an inclusion analyzer, PoDFA (manufactured by Pyrotek Co., Ltd.), and it was confirmed that the impurity amount was 0.2 $mm^2$/kg or less. Furthermore, because an effective addition amount of Mg varies with holding time in the melting furnace, deviation from a component target value was confirmed, using optical emission spectroscopy, and a Mg mother alloy was added to the molten metal to carry out component adjustment before casting. Furthermore, to improve the quality of the molten metal, degassing and fluxing with $N_2$ gas were performed.

(Casting)

The molten metal was convoyed into a holding furnace at 700° C., was poured into a mold in a state of being heated to 200° C., and was cast by GDC to obtain an intermediate. At this time, casting was performed so us to realize directional solidification by cooling the mold with water until solidification of the molten metal was completed. Furthermore, burrs generated during casting were removed using a trimming device, to obtain an intermediate.

(Forging)

The intermediate was heated using an electric furnace until it reached 525° C. (forging temperature). At this time, after confirming with a thermocouple that the temperature of the surface of the intermediate reached 525° C., heating was continued for about 30 minutes so that a uniform temperature would be obtained even in the inner part of the intermediate. Next, after confirming that the temperature of the mold reached 200° C., the intermediate was taken out from the electric furnace, and the intermediate was forged using a forging machine. At this time, the shape of the mold was designed so that an equivalent plastic strain was 0.2 or more over the entirety.

(Heat Treatment)

The intermediate after forging was subjected to a melting treatment and an artificial aging treatment to obtain an aluminum alloy workpiece. The conditions in the melting treatment were 6 hours at 540° C., and the conditions in the artificial aging treatment were 6.5 hours at 160° C.

Example 2

The same procedures were performed as in Example 1 to obtain an aluminum alloy workpiece, except that an aluminum alloy ingot consisting of Mg (0.6% by mass), Si (1.7% by mass), Cu (0.2% by mass), Mn (0.15% by mass), Ti (0.17% by mass), Cr (0.2% by mass), Sr (1 ppm by mass or less), and Al (balance) was used.

Example 3

The same procedures were performed as in Example 1 to obtain an aluminum alloy workpiece, except that the forging temperature was changed to 535° C.

Comparative Example 1

The same procedures were performed as in Example 1 to obtain an aluminum alloy workpiece, except that an aluminum alloy ingot consisting of Mg (0.6% by mass), Si (1.7% by mass), Cu (0.2% by mass), Mn (0.15% by mass), Ti (0.17% by mass), Sr (1 ppm by mass or less), and Al (balance) was used.

Comparative Example 2

The same procedures were performed as in Example 1 to obtain an aluminum alloy workpiece, except that an aluminum alloy ingot consisting of Mg (0.6% by mass), Si (1.7% by mass), Cu (0.2% by mass), Mn (0.15% by mass), Ti (0.17% by mass), Cr (0.3% by mass), Sr (1 ppm by mass or less), and Al (balance) was used.

Comparative Example 3

The same procedures were performed as in Example 1 to obtain an aluminum alloy workpiece, except that the forging temperature was changed to 525° C.

Comparative Example 4

The same procedures were performed as in Comparative Example 1 to obtain an aluminum alloy workpiece, except, that the forging temperature was changed to 400° C.

Crystal Grain Sizes of Aluminum Alloy Workpieces

Test pieces were cut out from each of the aluminum alloy workpieces. Next, the test pieces were polished to about #2000 of polishing paper, and then were subjected to final polishing using colloidal silica and ion milling. Then, each of the test pieces was set in a scanning electron microscope (SEM), and an area average crystal grain size of the test piece was measured using electron backscatter diffraction (EBSD). At this time, the grain size and area were acquired by setting a crystal misorientation of 15° or more as a crystal grain boundary.

Here, if a simple average crystal grain size is used, difference between an apparent crystal grain size and the average crystal grain size is increased, in a case in which a large number of crystal grains, each having a small area, are contained in a microstructure in which variation exists in the crystal grain sizes. Therefore, an area average crystal grain size $d_{ave}$ was calculated using the following formula:

$$d_{ave}=\Sigma_i d_i A_i/\Sigma_i A_i, \quad \text{[Equation 1]}$$

in which $d_i$ is an elliptically approximated grain size of the $i^{th}$ grain and $A_i$ is an area of the $i^{th}$ grain.

Figure 2:
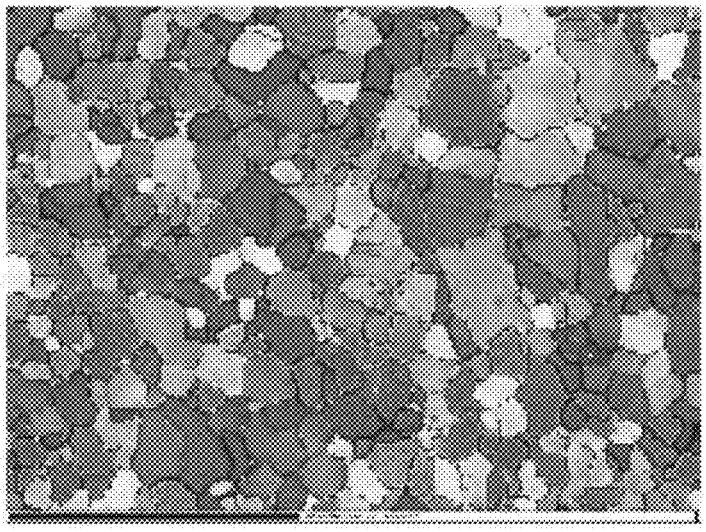
FIG. 2 is a diagram showing a crystal orientation map of the aluminum alloy workpiece of Example 3.
Figure 3:
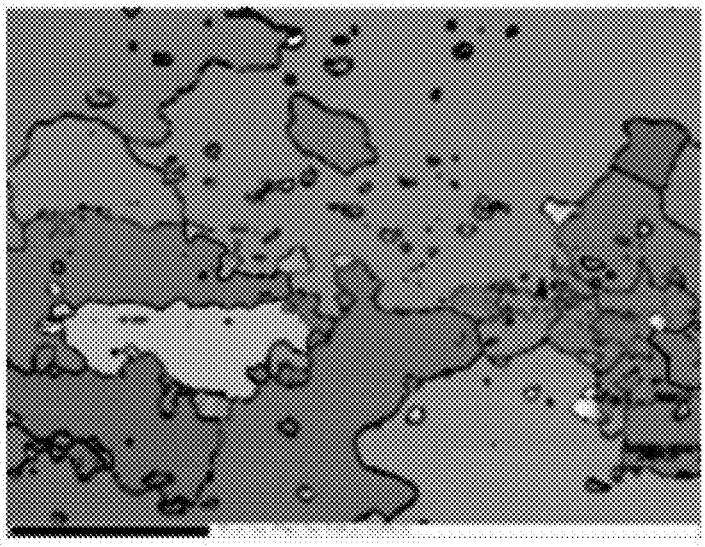
FIG. 3 is a diagram showing a crystal orientation map of the aluminum alloy workpiece of Comparative Example 1.
Figure 4:
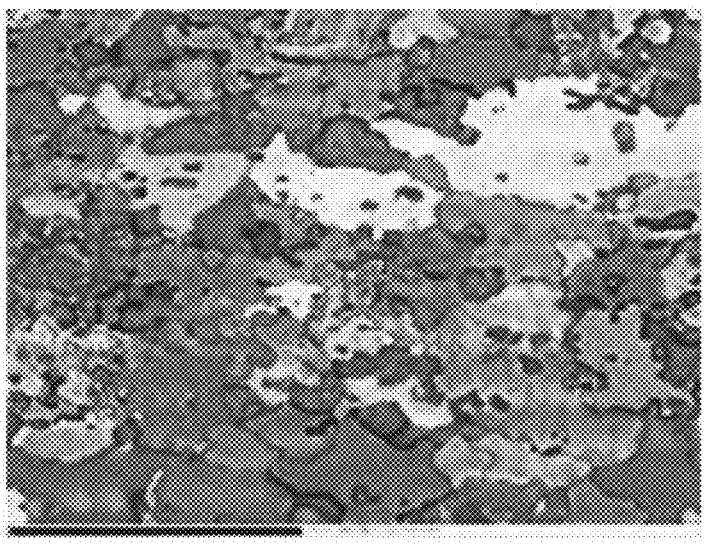
FIG. 4 is a diagram showing a crystal orientation map of the aluminum alloy workpiece of Comparative Example 3.
Figure 5:
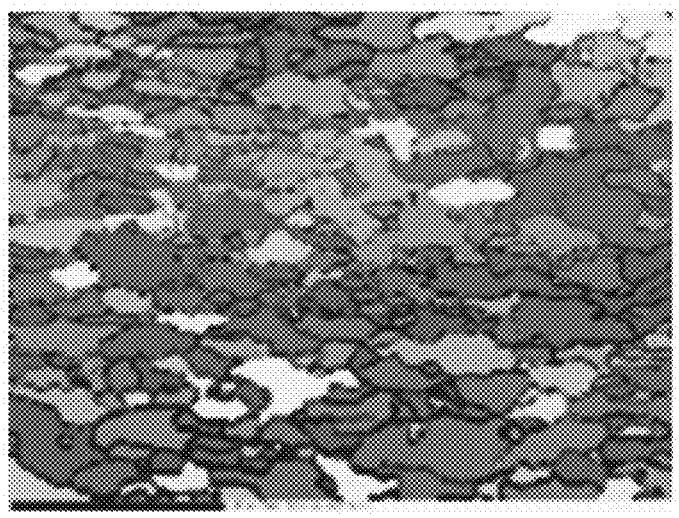
FIG. 5 is a diagram showing a crystal orientation map of the aluminum alloy workpiece of Comparative Example 4.

FIGS. 1 and 2 indicate crystal orientation maps of the aluminum alloy workpieces of Examples 1 and 3, respectively. FIGS. 3, 4, and 5 indicate crystal orientation maps of the aluminum alloy workpieces of Comparative Examples 1, 3 and 4, respectively.

Table 1 shows the area average crystal grain sizes of the aluminum alloy workpieces of Examples 1 to 3 and Comparative Examples 1 to 4.

TABLE 1

| | Content of Cr (% by mass) | Forging temperature (° C.) | Area average grain size (μm) |
|---|---|---|---|
| Example 1 | 0.1 | 575 | 106 |
| Example 2 | 0.2 | 525 | 160 |
| Example 3 | 0.1 | 535 | 61 |
| Comparative Example 1 | 0 | 525 | 775 |
| Comparative Example 2 | 0.3 | 525 | 103 |
| Comparative Example 3 | 0.1 | 400 | 129 |
| Comparative Example 4 | 0 | 400 | 129 |

From Table 1, it can be seen that the aluminum alloy workpieces of Examples 1 and 2 had smaller area average crystal grain sizes than the aluminum alloy workpiece of Comparative Example 1.

Yield Stress and Elongation of Aluminum Alloy Workpieces

Tensile tests were performed according to ISO6892-1 or JISZ 2241, and yield stress and elongation of the aluminum alloy workpieces were measured.

Figure 6:
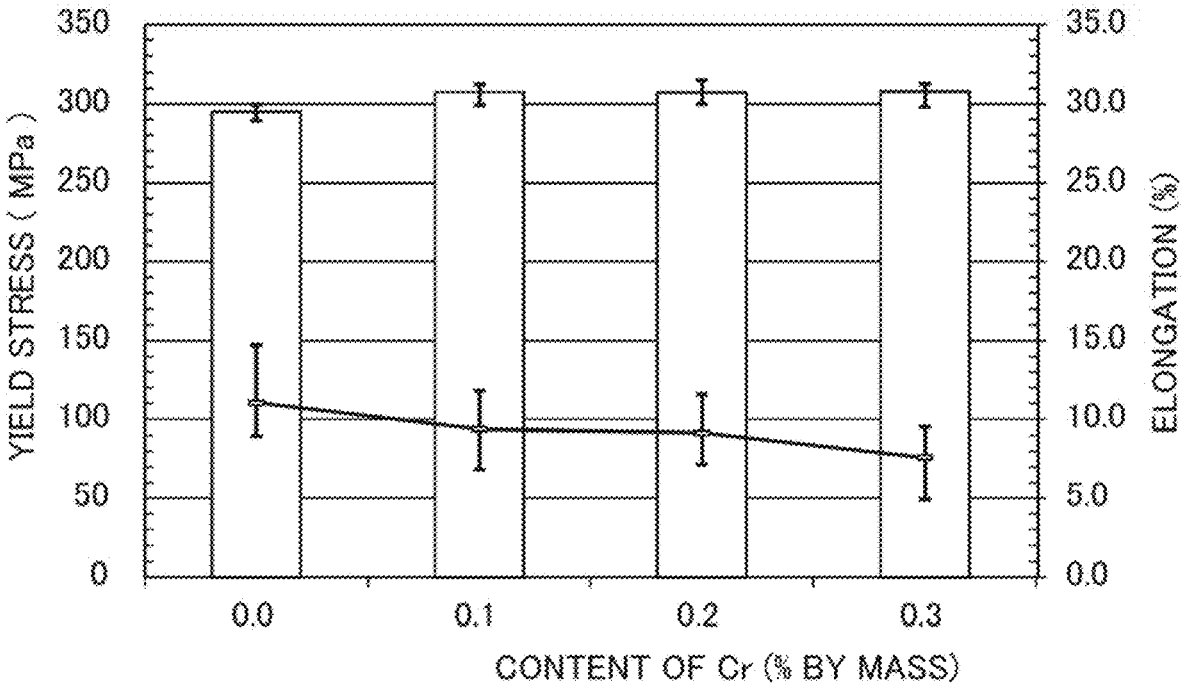
FIG. 6 is a diagram showing evaluation results of the yield stress and elongation of the aluminum alloy workpieces of Examples 1 and 2 and Comparative Examples 1 and 2.

FIG. 6 shows evaluation results of the yield stress and elongation of the aluminum alloy workpieces of Examples 1 and 2 and Comparative Examples 1 and 2. Herein, in FIG. 6, histograms and line graphs indicate the yield stress and the elongation of the aluminum alloy workpieces, respectively.

Table 2 shows evaluation results of the yield stress and elongation of the aluminum alloy workpieces of Examples 1 to 3 and Comparative Examples 1 and 2.

TABLE 2

| | Content of Cr (% by mass) | Forging temperature (° C.) | Yield stress (MPa) | Elongation (%) |
|---|---|---|---|---|
| Example 1 | 0.1 | 525 | 307 | 9.4 |
| Example 2 | 0.2 | 525 | 307 | 9.2 |
| Example 3 | 0.1 | 535 | 304 | 9.7 |
| Comparative Example 1 | 0 | 575 | 294 | 11.0 |
| Comparative Example 2 | 0.3 | 525 | 308 | 7.6 |
| Comparative Example 3 | 0.1 | 400 | 301 | 11.9 |
| Comparative Example 4 | 0 | 400 | 299 | 12.8 |

From FIG. 6 and Table 2, it can be seen that the aluminum alloy workpieces of Examples 1 to 3 satisfy both the yield stress and the elongation.

Contrary to this, the aluminum alloy workpiece of Comparative Example 1 had a low yield stress, because of the content of Cr being 0% by mass.

The aluminum alloy workpiece of Comparative Example 2 had a poor elongation, because of the content of Cr being 0.3% by mass.

The aluminum alloy workpiece of Comparative Example 3 was forged at 400° C., and thus could not obtain an effect that the area average crystal grain size decreases by addition of Cr, compared to the aluminum alloy workpiece of Comparative Examples 4, which was forged at the same temperature. Thus, the aluminum alloy workpiece of Comparative Example 3 had a low yield stress.

The aluminum alloy workpiece of Comparative Example 4 was forged at 400° C. and therefore had a low yield stress, though the area average crystal grain size was decreased.

What is claimed is:

1. A method for producing a workpiece of an aluminum alloy having an average crystal grain size of 200 μm or less by processing an aluminum alloy comprising: 0.5% by mass or more and 1.0% by mass or less of Mg, 1.5% by mass or more and 3.0% by mass or less of Si, 0.2% by mass or more and 0.4% by mass or less of Cu, 0.15% by mass or more and 0.25% by mass or less of Mn, 0.15% by mass or more and 0.2% by mass or less of Ti, 0.05% by mass or more and 0.2% by mass or less of Cr, and 120 ppm by mass or less of Sr, the method comprising casting the aluminum alloy and forging the cast aluminum at a temperature of 500° C. or more and 535° C. or less.

2. The method for producing a workpiece of an aluminum alloy according to claim 1, wherein the aluminum alloy comprises 0.1% by mass or more and 0.2% by mass or less of Cr.

* * * * *